United States Patent [19]

Ruiz et al.

[11] Patent Number: 4,771,602

[45] Date of Patent: Sep. 20, 1988

[54] GAS PURIFICATION SYSTEM THROUGH A FILTER SYSTEM, ESPECIALLY APPLICABLE TO INTERNAL COMBUSTION ENGINES

[76] Inventors: Jose E. Ruiz, Ciudad Pegaso-calle 5-chalet 5-bajo D; Jose M. E. Calvo, Batel, 12-20 D, both of 28042 Madrid, Spain

[21] Appl. No.: 11,594

[22] Filed: Feb. 6, 1987

[30] Foreign Application Priority Data

Feb. 10, 1986 [ES] Spain ..... 551.810

[51] Int. Cl.[4] ..... F02M 25/06

[52] U.S. Cl. ..... 60/278; 60/311; 123/568; 123/571

[58] Field of Search ..... 60/278, 311, 315; 123/568, 571

[56] References Cited

U.S. PATENT DOCUMENTS

| | | | |
|---|---|---|---|
| 3,035,561 | 5/1962 | Siegler | 123/568 |
| 3,204,621 | 9/1965 | Holliday | 123/568 |
| 3,262,437 | 7/1966 | Bradshaw | 123/568 |
| 3,548,591 | 12/1970 | McKay | 60/311 |
| 3,633,343 | 1/1972 | Mark | 60/311 |
| 3,642,259 | 2/1972 | Bowden | 60/311 |
| 3,675,398 | 7/1972 | Giarrizzo | 60/311 |
| 3,786,635 | 1/1974 | Kates | 60/310 |
| 4,276,865 | 7/1981 | Hamai | 123/571 |
| 4,373,498 | 2/1983 | Ushimura | 123/571 |
| 4,578,091 | 3/1986 | Borja | 60/311 |

FOREIGN PATENT DOCUMENTS

| | | | |
|---|---|---|---|
| 2163969 | 3/1986 | United Kingdom | 60/311 |

*Primary Examiner*—Douglas Hart
*Attorney, Agent, or Firm*—Ladas & Parry

[57] ABSTRACT

A gas purification system through a filter system, especially applicable to an internal combustion engine, comprising engine exhaust ducting, an exhaust pipe, an expander on the exhaust pipe between a muffler and the exhaust ducting, a duct connected to the expander for diverting escape gases from the exhaust pipe, a pressure reducer on the duct to suck the gases from the exhaust pipe, a series of filtering parts serially interconnected on the duct between the expander and the pressure reducer to filter the gases, a regulator located between the pressure reducer and the filtering parts, a relay connected to the pressure reducer to start or stop the operation of the pressure reducer, a contactor connected to the engine to detect changes in the engine speed, an electronic circuit connected to both the relay and contactor so as to signal the relay when the contactor detects that the engine is idling or beginning to accelerate, and a delay switch connected to both the relay and electronic circuit so as to momentarily delay the shutoff signal from the electronic circuit to the relay.

3 Claims, 1 Drawing Sheet

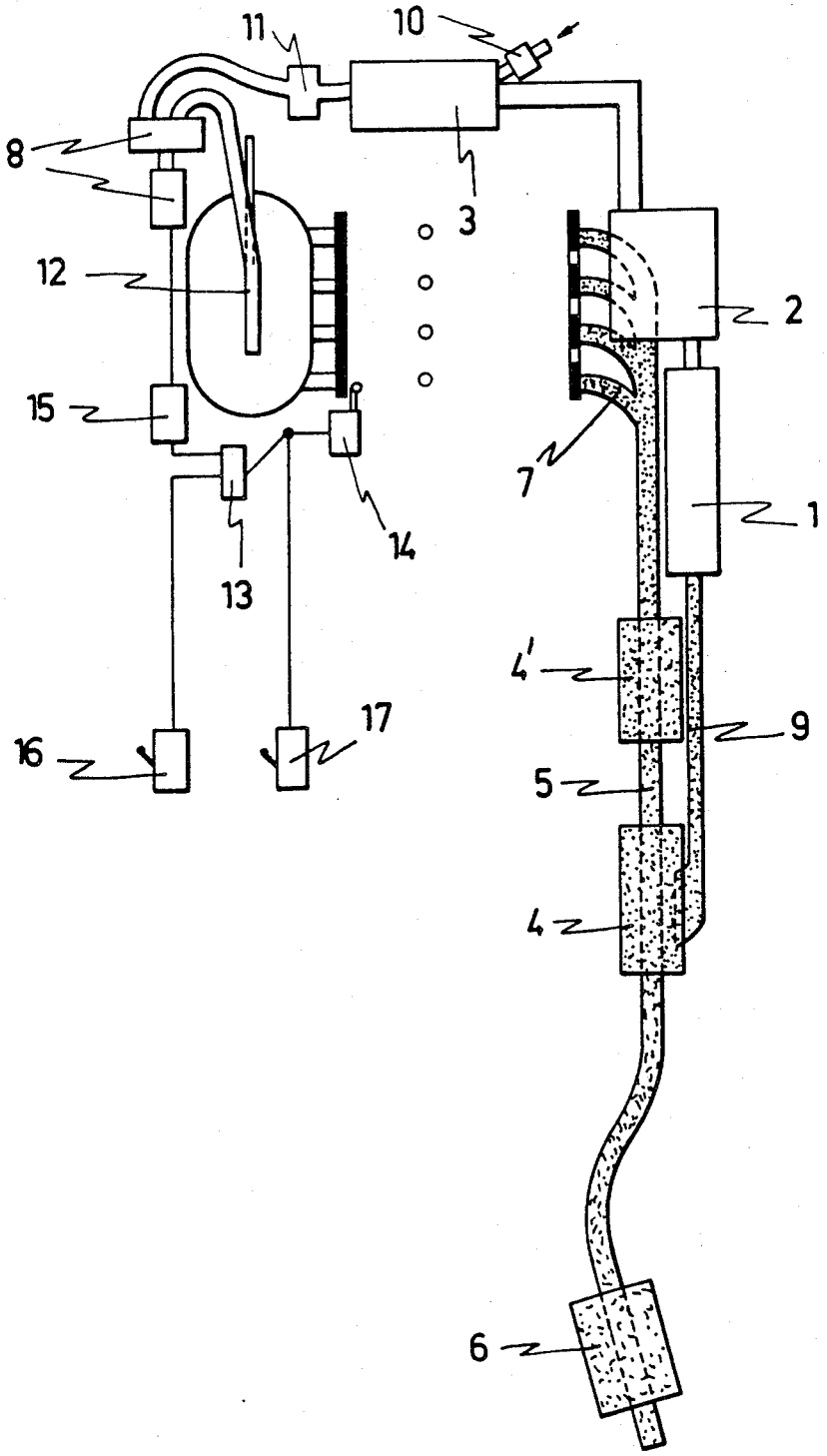
11
10
8
3
12
2
15
7
1
14
13
4'
9
16
17
5
4
6

GAS PURIFICATION SYSTEM THROUGH A FILTER SYSTEM, ESPECIALLY APPLICABLE TO INTERNAL COMBUSTION ENGINES

BACKGROUND OF THE INVENTION

The present invention, as is expressed by the title of this specification, refers to a gas purification system, incorporating a filter system. This system is applicable to internal combustion engines.

SUMMARY OF THE INVENTION

An object of the invention is to reduce air pollution from vehicle emissions.

This objective is accomplished by means of a series of filtering devices arranged serially and connected to an expander on the exhaust pipe. The expander is a common element in exhaust systems and is used to reduce the speed and pressure of the exhaust gases before they enter the muffler. To achieve this result, the expander has an enlarged cross sectional area, as compared to the exhaust pipe, so that the gases can expand, thereby reducing their speed and pressure.

Connected downstream of the filters is a pressure reducer, or pump, that sucks 60 to 90% of the exhaust gases out of the expander and through the filters. The pressure reducer automatically operates when the vehicle is in neutral. When these gases have been conveniently filtered and mixed with a certain proportion of outside air, they are returned to the inlet duct of the engine to be mixed with fuel by the carburetor or injection system.

The suction of gases continues for a few seconds after the engine accelerates by means of an electronic delay or timer switch. In this manner, the gases from the acceleration of the engine are also cleaned. It is known that a larger amount of these gases are produced during acceleration from neutral than when the engine runs normally.

The filtering system is comprised of an initial filter consisting of undulated sheets; a second filter of synthetic fibers and activated carbon; and a third filter of foam rubber.

To detect when the engine is idling, as well as when the vehicle begins to accelerate, the present invention uses a vacuum activated contactor. Once the contactor detects the engine idling, or the acceleration of a previously idling engine, it signals an electronic circuit which in turn signals a relay switch. The relay switch is connected to the pressure reducer and controls when the pressure reducer turns on and off. A permanent operation switch of the purification system has also been foreseen which activates the system throughout the engine's entire operating conditions rather than just the idling stage. The system thereby operates independently of the engine speed.

BRIEF DESCRIPTION OF THE DRAWINGS

For a better understanding of this specification and as an integral part thereof, attached hereto is a single sheet of drawings, wherein the gas purification system applied to an internal combustion engine, according to the invention, has been represented diagrammatically in a single, illustrative, non-restrictive FIGURE.

DESCRIPTION OF THE PREFERRED EMBODIMENT

Referring to the numbering indicated in the FIGURE, the engine escape gas purification system is formed by a system of filters numbered (1), (2) and (3). These filters are arranged serially and are connected to the expander (4). In addition, expander (4) is connected to exhaust pipe (5), between muffler (6) and collector or exhaust ducting (7). According to the FIGURE, the engine escape gases leave the engine through collector or exhaust ducting (7), pass through intermediate expander (4') and expander (4) and then move through muffler (6) to be expelled out the exhaust pipe.

Part of the gases that pass through expander (4), around 60 to 90% of the gases produced, are sucked up by the pressure reducer (8), through the duct (9), so as to respectively pass through attached filters (1), (2) and (3).

First filter (1) is made of undulated sheets while second filter (2) is made of synthetic fibers and activated carbon with respect to third filter (3) it is made of foam rubber and is connected to an adjustable flow outside air intake (10). Connected to filter (3) is regulator (11) which mixes the purified exhaust gases with the fresh air supplied through intake (10). This mixture is then returned to the engine through inlet duct (12), where it is combined with the fuel by the carburetor or injection system. Since the mixture is rich in gasified fuel, smaller amounts of new fuel, as compared to the amounts normally used, are needed for combustion. Consequently, fuel consumption is reduced.

The gas purification system acquires relevant importance when the engine is running in neutral and when acceleration thereof begins, since this is when the escape fumes are most polluted. To engage the purification system, when the engine begins to idle, electronic circuit (13) signals relay (15) to start pressure reducer (8) in response to low engine speed which is detected by vacuum-activated contractor (14). Once contactor (14) detects the engine idling and signals electronic circuit (13), which in turn signals relay (15), pressure reducer (8) begins to suck part of the escape gases through the purification system.

To further clean the exhaust gases, pressure reducer (8) continues to operate even as the engine accelerates out of idle. Specifically, a delay switch, not shown in the drawing, delays the shutoff signal from electronic circuit (13) to relay (15). In this manner, pressure reducer (8) momentarily continues to operate although the engine is no longer idling.

In the diagram shown in the FIGURE, switch (16) engages and disengages the whole system, while switch (17) causes electronic circuit (13) to allow the system to operate constantly at all engine speeds.

What is claimed is:

1. Gas purification system though a filter system, especially applicable to an internal combustion engine, comprising:

engine exhaust ducting connected to the engine;

an exhaust pipe connected to the exhaust ducting;

an expander on the exhaust pipe located between the exhaust ducting and a muffler;

a duct, connected to the expander, for diverting escape gases from the exhaust pipe;

an automatically operated pressure reducer, located on the duct, which sucks from 60 to 90% of the escape gases given off while the engine is running in neutral;

a series of filtering parts, serially interconnected on the duct between the expander and the pressure reducer, for purifying the escape gases that are sucked by the pressure reducer;

a regulator, located between the pressure reducer and the filtering parts, that mixes the filtered gases in adequate proportions with air and returns the mixture to an engine inlet duct;

a relay, connected to the pressure reducers, for starting or stopping the operation of the pressure reducer;

a contactor, connected to the engine, for detecting changes in engine speed;

an electronic circuit, connected between the contactor and the relay, for signaling the relay when the contactor detects that the engine is idling or is beginning to accelerate; and a delay switch, connected between the relay and the electronic circuit, that momentarily delays the shutoff signal from the electronic circuit to the relay when the engine begins to accelerate out of idle.

2. Gas purification system through a filter system, especially applicable to an internal combustion engine, according to claim 1, wherein the filtering system is made up of a first filter of undulated sheets, a second filter of synthetic fibers and activated carbon and a third filter of foam rubber.

3. Gas purification system through a filter system, especially applicable to an internal combustion engine, according to claim 1, wherein the electronic circuit includes a permanent operation switch which allows the system to operate at all engine speeds.

* * * * *

UNITED STATES PATENT AND TRADEMARK OFFICE

CERTIFICATE OF CORRECTION

PATENT NO. : 4,771,602

DATED : September 20, 1988

INVENTOR(S) : Jose ESTEBAN RUIZ and Jose M. ESTEBAN CALVO

It is certified that error appears in the above-identified patent and that said Letters Patent is hereby corrected as shown below:

On the Title Page, under Item [19], "Ruiz et al." should read --Esteban Ruiz et al.-- and on the Title Page, Item [76], "Inventors: Jose E. Ruiz, Ciudad Pegaso Calle 5-Chalet 5-bajo D; Jose M. E. Calvo, Batel, 12-20 D, both of 28042 Madrid, Spain" should read-- Inventors: Jose ESTEBAN RUIZ, Ciudad Pegaso-Calle 5-Chalet 5-bajo D; Jose M. ESTEBAN CALVO, Batel, 12-20 D, both of 28042 Madrid, Spain--.

Signed and Sealed this

Eleventh Day of July, 1989

*Attest:*

*Attesting Officer*

DONALD J. QUIGG

*Commissioner of Patents and Trademarks*